US006915981B2

(12) United States Patent
Shinohara et al.

(10) Patent No.: US 6,915,981 B2
(45) Date of Patent: Jul. 12, 2005

(54) RECORDING PAPER ROLL

(75) Inventors: Hideaki Shinohara, Nishi-Tokyo (JP); Yoshimasa Tanaka, Tokyo (JP); Satoru Ohashi, Utsunomiya (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/226,449

(22) Filed: Aug. 23, 2002

(65) Prior Publication Data

US 2003/0047638 A1 Mar. 13, 2003

(30) Foreign Application Priority Data

Aug. 31, 2001 (JP) ..... P2001-263819

(51) Int. Cl.[7] ..... B65H 75/28
(52) U.S. Cl. ..... 242/532.3; 242/583
(58) Field of Search ..... 242/532.3, 583

(56) References Cited

U.S. PATENT DOCUMENTS 3,321,149 A 5/1967 Frits
5,427,850 A * 6/1995 Gotoh et al.
5,804,302 A 9/1998 Tamura et al.
6,063,493 A * 5/2000 Saitou et al. ..... 428/354
6,074,290 A * 6/2000 Ko et al. ..... 451/390
6,443,387 B1 * 9/2002 Mercer et al. ..... 242/532.3
6,756,101 B2 * 6/2004 Manteufel et al. ..... 242/532.3
2002/0027179 A1 * 3/2002 Fujiwara et al. ..... 242/532.3

FOREIGN PATENT DOCUMENTS

DE 33 17 370 12/1984
FR 2 744 994 A 8/1997

OTHER PUBLICATIONS

Patent Asbtracts of Japan vol. 2000, No. 14, Mar. 5, 2001 & JP 2000 309472, Nov. 7, 2000.
Patent Abstracts of Japan vol. 1997, No. 5 May 30, 1997 & JP 9 001905, Jan. 7, 1997.

* cited by examiner

*Primary Examiner*—John M. Jillions
(74) *Attorney, Agent, or Firm*—Michael J. Striker

(57) ABSTRACT

A recording paper roll in which a lengthy recording paper is wound by a bobbin comprises an adhesive tape as a means for adhering the initial take-up section of the recording paper to the bobbin. The adhesive tape comprises a layer of pressure sensitive adhesives provided on both surfaces of a film laminate on which two synthetic resin films have been laminated detachably so that a residue of starch paste or adhesives which has been used to adhere the initial take-up section to the bobbin does not entrap into a printer, which is accompanied by the recording paper.

2 Claims, 1 Drawing Sheet

RECORDING PAPER ROLL

BACKGROUND OF THE INVENTION

1. Field of the Invention

The present invention relates to the improvement of a recording paper roll in which a lengthy paper roll, for example, heat sensitive recording paper, thermal transfer recording paper, pressure sensitive recording paper and ink jet recording paper, is taken up by a bobbin, and, in particular, it relates to the improvement of the adhesive means in which the initial take-up section of a lengthy recording paper adheres more effectively to the bobbin.

2. Description of the Related Art

Lengthy recording paper rolls are widely used in a variety of printers because of their ability to feed paper continuously for long periods of operation. In this kind of paper roll, it is common that the end (the initial take-up section) of a recording paper roll adheres first to the bobbin, reel, spool or the like. If this process is omitted, and a recording paper roll is loaded into a printer, the bobbin and the paper may fail to catch each other due to the tension applied to the paper in the printer. As a result, the appropriate tension which is required in the printing process may not be retained to the recording paper.

Conventionally, such a lengthy recording paper is usually secured to a bobbin or spool at the initial take-up section by using a starch paste or a double-sided adhesive tape, before winding around the bobbin.

However, in cases where a printing paper roll in which the initial take-up section is bonded to a bobbin or reel by starch paste or a double-sided adhesive tape is loaded and completely run through the printer, following problems may occur.

That is, when such printing paper in which the initial take-up section is wound up by a bobbin is run through in a printer, the initial take-up section of the paper will detach from the bobbin to be fed. In this case, a residue of starch paste or a double-sided adhesive tape usually remains on the paper which has been removed from the bobbin. If such a residue passes through a printer, the starch and adhesive will stick to a carrying roll and printer head, which causes jamming and/or image formation impediment, i.e. printing is impaired or fails.

SUMMARY OF THE INVENTION

The present invention has been developed to solve the problems described above. Accordingly, it is the object of the present invention to provide a recording paper roll in which a lengthy recording paper can be wound by a bobbin with the specific means to adhere the initial take-up section of the recording paper to the bobbin.

In order to achieve the aforementioned object, the recording paper roll in which a lengthy recording paper is wound by a bobbin according to the present invention is comprised of an adhesive tape as a means for adhering the initial take-up section of the recording paper to the bobbin, said adhesive tape comprises a film laminate formed by detachably laminating two synthetic resin films and a layer of pressure sensitive adhesives provided on both surfaces of the film laminate.

The above described adhesive tape used in the present invention has greater adhesive strength to the bobbin of the pressure sensitive adhesive layers provided on both surfaces thereof, to the recording paper, and to the two synthetic resin films, respectively, than to that between synthetic resin films. Therefore, when the force to release the adhesion is applied to the bonding site of the recording paper and the bobbin, the adhesive tape can detach at the interface of the two synthetic resin films.

DESCRIPTION OF PREFERRED EMBODIMENTS

Figure 1:
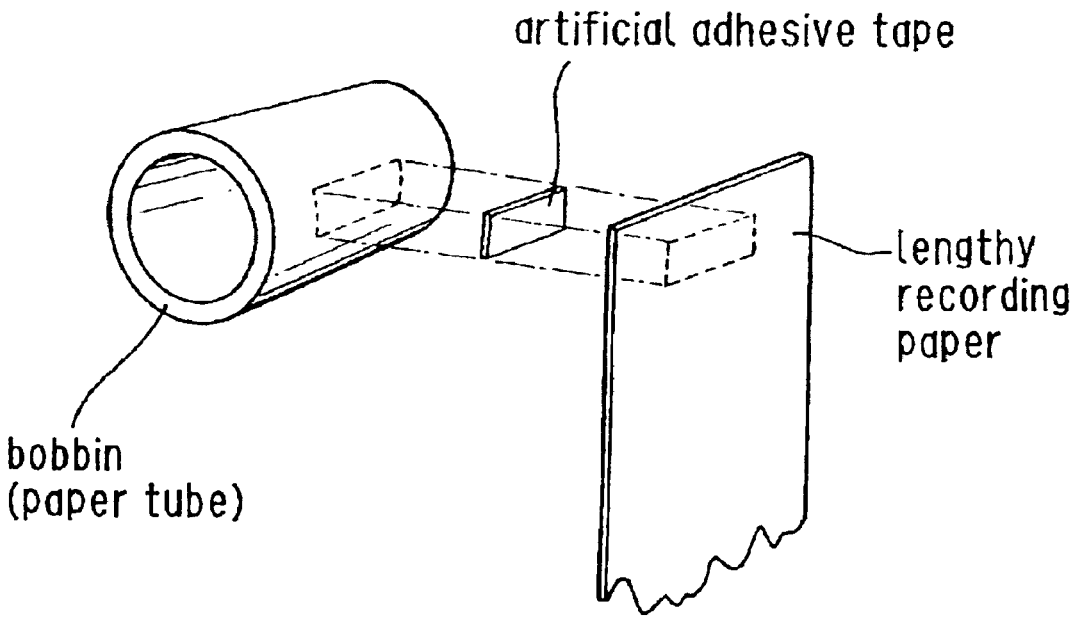
FIG. 1 is an illustration showing an example of a relative connection of a bobbin (paper tube), an adhesive tape (artificial adhesive tape), and the initial take-up section of a lengthy recording paper of the recording paper roll, with respect to the present invention.

The present invention will be described more in detail in conjunction with a set of examples. However, it is understood that the present invention is not limited thereto.

In a recording paper roll according to the present invention, a bobbin that winds a lengthy recording paper is normally formed in a cylindrical shape, but it can be also formed in a polygonal tubular shape. Further, such a bobbin is typically a paper tube or made of plastic, but different materials can be used, such as wood or metal other than paper or plastic. Many lengthy recording papers can be wound by a bobbin, such as heat sensitive recording paper, thermal transfer recording paper, pressure sensitive recording paper and ink jet recording paper as well as a general paper such as printing paper. These papers may be tack processed. Any kind of recording paper can be used for a recording paper roll according to the present invention. Moreover, the size of the recording paper roll, i.e. the length to be wound and/or the width of the paper can be selected arbitrarily.

According to the present invention, an adhesive tape for binding the initial take-up section of the lengthy recording paper to the bobbin can be obtained by detachably laminating two synthetic resin films, and providing a pressure sensitive adhesive layer on both surfaces of the film laminate. Any kind of materials can be used for such two synthetic resin films to form a film laminate if they adhere artificially at their interface. Therefore, not only polyolefine film and polyester film which will be explained below but also synthetic resins such as polyolefine resin or polyester resin for forming a sheet of synthetic paper by the film method and a sheet of non-woven fabric by the filament method (JP Utility Model Registration No. 3002758) can be used for the synthetic resin film to form the film laminate.

The term "adhere artificially" described above refers to the status that an interface between laminated synthetic resin films is adhered in an ordinary state while such two synthetic films can be easily separated at the interface due to the application of some detaching force. That is to say, the purpose of the adhesion is temporary and aims to be separated easily without any residue on the adhesive surface. Thus, an adhesive tape used in the present invention can be also referred to as an artificial adhesive tape.

An adhesive tape having such a pressure sensitive adhesive layer on both sides of the above film laminate exposes the pressure sensitive adhesive layer. This makes it inconvenient to handle. To overcome this inconvenience, for instance, two types of adhesive tapes in use for the present invention can be provided in a manner described below: One is formed by adhering a tape-type peel paper to one surface of a double-sided adhesive tape and cutting it in an arbitrary length. Thus obtained plural tapes, one surface adhesive, are then adhered to a sheet-type peel paper orderly so as to cover an entire surface of the sheet-type peel paper through the exposed pressure sensitive adhesive layer. The other type is a roll adhesive tape. A tape-type peel paper, detaching treatment applied to both sides thereof, is sandwiched between two adhesive layers and is taken up by an appropriate core roll.

The width and length of the adhesive tape used in the present invention can be determined arbitrarily in accordance with the size of a recording paper roll to be manufactured. However, it is normally within the range of 5–100 mm in a peripheral direction of a bobbin, and of 10–300 mm in an axial direction of a bobbin. It is also preferable that the thickness of the adhesive tape is 50–150 $\mu$m excluding the thickness of the peel paper.

In the adhesive tape according to the present invention, the pressure sensitive adhesive layer formed on both surfaces of the film laminate contributes to the adhesion of a synthetic resin film and a bobbin and the adhesion of the synthetic resin film and a recording paper. In other words, in the recording paper roll of the present invention, the above described film laminate is adhered to a bobbin through one pressure sensitive adhesive layer while it is adhered to the initial take-up section of the recording paper through the other pressure sensitive adhesive layer. In this case, it is important to make the strength of the adhesive force, i.e. anti-detaching force, between the laminated two synthetic resin films is not stronger than that of the adhesion between the pressure sensitive adhesive layer and the synthetic resin film, between the pressure sensitive adhesive layer and the bobbin, or between the pressure sensitive adhesive layer and the recording paper.

As a result, when the force to separate the recording paper from the bobbin is applied, the adhesive tape used for binding the bobbin and the recording paper can be separated selectively and preferentially at the interface of the laminated two synthetic resin films. After separated, the surface of the synthetic resin film (artificial adhesive surface) normally does not have adhesion.

One example is given for a preferred film laminate to obtain such an adhesive tape. In order to obtain such a laminated body, two polyolefine resin films are laminated by thermo compression bonding. In this case, polyolefine resin films such as polyethylene film or polypropylene film can be used. Another example of the film laminate can be obtained by laminating polyolefine resin film and polyester resin film by the extruding laminate method. In this case, films such as polyethylene film or polypropylene film can be used as polyolefine resin film, while films such as polyethylene terephthalate or the like can be used as the polyester resin film.

Further, another example of the film laminate of the present invention is provided to form a polyolefine resin layer by laminating polyester resin film with polyolefine resin by the melt extruding laminate method.

Moreover, an adhesive tape of the present invention includes a film laminate having pressure sensitive adhesive layers on its both surfaces, the film laminate formed by laminating the polyolefine resin with the aforementioned non-woven fabric according to the melt extrusion method so that the tape can be cut easily by hand. Therefore, when this kind of adhesive tape is used to manufacture a recording paper roll of the present invention, the workability can be improved. Once these film laminates are detached at the laminated surface, such detached surface loses adhesion in an ordinary state. The peel strength (artificial adhesive strength) of the film laminate is preferably within the range of 50–250 g/50 mm wide when measured pursuant to JIS-Z-0237.

Regardless of the selection of the laminated body to be used, the thickness of each synthetic resin film which constitutes the laminated body is preferably within the range of 5–100 $\mu$m.

Various pressure sensitive adhesive such as rubber elastomer, acrylic resin, polyurethane resin, polyester resin, silicone resin or the like can be used to form the pressure sensitive adhesive that is provided on both surfaces of the above described film laminate. Homopolymer of acrylate or methacrylate selected from 2-ethylhexyl acrylate, butyl acrylate, ethyl acrylate and methyl methacrylate, or copolymer of the above acrylic and vinyl monomers such as vinyl acetate or vinyl ether can be used as acrylic resin.

The thickness of the pressure sensitive adhesive layer is preferably within the range of 5–50 $\mu$m which corresponds to 6–55 g/m$^2$, preferably 15–35 g/m$^2$, in terms of the coating amount of the pressure sensitive adhesive. When the coating amount is smaller than 6 g/m$^2$ the cohesion may not be enough. In the meantime, when the coating amount is greater than 55 g/m$^2$, the pressure sensitive adhesive may hang out.

As explained above, the adhesive tape of the present invention comprises pressure sensitive adhesive layers on both surfaces of the film laminate, and is formed by adhering a peel paper to the exposed surface of the pressure sensitive adhesive layers to avoid any possible inconvenience. As a matter of course, such peel paper is removed when the initial take-up section of the length recording paper is adhered to the bobbin. If a surface of the recording paper to record or print characters and/or images is referred to the front face, the rear surface of the paper is bonded to the bobbin through the above adhesive tape.

When the recording paper roll of the present invention is loaded in a printer and used for recording of characters and/or images, the wound recording paper is sequentially fed, and finally rewound until the part where the paper has been initially bounded to the bobbin. When the tensile force from a carriage roll is loaded to the recording paper under these conditions, the adhesive tape used to bond the recording paper and the bobbin is detached at the interface of the two synthetic resin films. Accordingly, one of the synthetic resin films is left adhered by the pressure sensitive adhesive, which is to be supplied to the carriage roll and printer head. However, the thickness of the synthetic resin film and the pressure sensitive adhesive which constitute the adhesive tape used in the present invention is very thin, and the synthetic resin film removed from laminated interface no longer has adhesive strength. Therefore, even though the adhesive tape, adhered to the recording paper, is supplied into the printer, an inconvenience will not occur in the paper feeding mechanism of the printer. Furthermore, it will not adhere to the carriage roll and/or the printer head.

EXAMPLE

To obtain a film laminate whose thickness was 45 $\mu$m, polyethylene was melt extruded from the T-die at the temperature of 290° C. to laminate one surface of a polyethylene terephthalate film whose thickness was 20 $\mu$m.

To obtain a peel paper in which both surfaces were treated for separation (a double-sided peel paper), after melt extruding polyethylene from the T-die at the temperature of 320° C. to laminate the both surfaces of a woodfree paper (80 g/m$^2$), silicone resin was coated on a surface of each polyethylene layers (25 μm thick) by gravure coating method. The similar procedure was repeated to obtain a peel paper in which only one surface was treated for separation (a single-sided peel paper.)

Next, pressure sensitive adhesive layer was formed on one surface of each of the double-sided peel paper and the single-sided peel paper (the surface to which separation treatment had been applied), by coating acrylic adhesive (product code: BPS-5169, Toyo Ink Co., Ltd.) in an amount of 20 g/m$^2$ as a solid matter respectively. Then, the double-sided peel paper was adhered to one side of the film laminate while the single-sided peel paper was adhered to the other side of the film laminate through their sensitive adhesive layers, respectively so as to obtain an adhesive tape in a way of sandwiching the film laminated body by the two peel papers. Thereafter, the adhesive tape was wound up by a suitable core material, only the single-sided peel paper peeled off. Then, a roll-type adhesive tape of 10 mm wide was obtained by applying slitting process.

According to dry laminate method, biaxially oriented polyolefine film (trade name: HGU50, thickness: 50 μm/Yupo Corporation) was then adhered to both surfaces of a coated paper of 55 μm thick (trade name: OK coat L, basis weight: 64 g/m$^2$/Oji Paper Co., Ltd.) by use of polyester adhesive to obtain a lengthy supporting sheet.

Then, according to the bar coating, the anchor coating composition as described below was applied to one surface of the supporting sheet in an amount of 1 g/m$^2$ after the coated material was dried. After that, by the same coating method, the coating composition for forming heat transfer image receptive layer as described below is applied to a surface of the anchor coating layer in an amount of 6 g/m$^2$ after the coated material was dried so as to obtain a lengthy recording paper on which images can be recorded by the heat transfer.

<Anchor Coating Composition>

Polyethylene imine: 4 parts by weight (trade name: PSP061/Nippon Shokubai Co., Ltd.)

Ethanol: 100 parts by weight

<Coating composition for forming heat transfer image receptive layer>

Polyester resin: 100 parts by weight (trade name: Bylon 200/Toyobo Co., Ltd.)

Silicone oil: 3 parts by weight (trade name: KF393/Sinetsu Kagaku Kogyo Co., Ltd.)

Isocyanate: 5 parts by weight (trade name: TakenateD-110N/ Takeda Chemical Industries, Ltd.)

Toluene: 300 parts by weight

The recording paper roll of the present invention was obtained by bonding the initial take-up section of a recording paper and a bobbin (paper tube) by the adhesive tape unwound from the above described roll-type adhesive tape so as to wind the lengthy recording paper around the bobbin.

The length of the adhesive tape used to bond the bobbin and the recording paper can be determined arbitrarily depending on the width of the paper. In general, an adhesive tape of 10 mm wide and 50 mm long will be good enough for a recording paper of 100 mm wide to bond the bobbin and the recording paper.

Under the identical conditions in which thus obtained recording paper roll is normally used in a printer, the paper roll was rewound to the initial take-up section and removed from the bobbin. The adhesive tape was separated at the artificial adhesive surface of its film laminate while one synthetic resin film was left to the bobbin, and the other synthetic resin film was left to the recording paper. However, no cohesion could be found on either resin films.

For a comparison, the same procedure was repeated to produce a recording paper roll except that a typical both-sided adhesive tape, pressure sensitive adhesive layer provided on both surfaces of a synthetic resin film, was used instead of the adhesive tape having the film laminated that is artificially adhered. Then, under the same conditions as above, it was rewound to the initial take-up section and removed from the bobbin. As a result, the synthetic resin film of the both-sided adhesive tape was left either the recording paper or the bobbin, and besides, in either case, pressure sensitive adhesive was adhered to the recording paper removed from the bobbin.

What is claimed is:

1. A recording paper roll wherein a lengthy recording paper is wound by a bobbin, comprising an adhesive tape for adhering the initial take-up section of the recording paper to the bobbin, said adhesive tape comprising a film laminate formed by detachably laminating two synthetic resin films and a layer of pressure sensitive adhesives provided on both surfaces of the film laminate, wherein a peel strength between the films of the laminate is less than a peel strength between the film laminate and the bobbin and the film laminate and recording paper, wherein said film laminate is obtained by extrusion-laminating polyolefine resin film and polyester resin film, or by melt-extrusion-laminating polyolefine resin to polyester resin film.

2. A recording paper roll as defined in claim 1, wherein said polyolefine resin film is polyethylene resin film while said polyester resin film is polyethylene terephthalate film.

* * * * *